US008225904B2

(12) United States Patent
Davis

(10) Patent No.: US 8,225,904 B2
(45) Date of Patent: Jul. 24, 2012

(54) APPARATUS FOR SUPPORTING A WORKER ON AN UPPER CHORD OF A ROOF TRUSS

(76) Inventor: Lennie Davis, North Platte, NE (US)

( * ) Notice: Subject to any disclaimer, the term of this patent is extended or adjusted under 35 U.S.C. 154(b) by 414 days.

(21) Appl. No.: 12/462,948

(22) Filed: Aug. 12, 2009

(65) Prior Publication Data

US 2011/0036663 A1 Feb. 17, 2011

(51) Int. Cl.
*E04G 1/36* (2006.01)

(52) U.S. Cl. ..... 182/45; 182/150

(58) Field of Classification Search ..... 182/45, 182/150

See application file for complete search history.

(56) References Cited

U.S. PATENT DOCUMENTS

| | | | | |
|---|---|---|---|---|
| 1,599,209 | A | 6/1923 | Cashman | |
| 1,886,921 | A | 7/1930 | Tobin | |
| 2,854,292 | A * | 9/1958 | Schaeffer | 182/132 |
| 4,570,749 | A | 2/1986 | McKibbin | |
| 4,928,789 | A * | 5/1990 | Claeys | 182/3 |
| 5,148,890 | A * | 9/1992 | Sipe | 182/45 |
| 5,524,727 | A * | 6/1996 | Yennie, Jr. | 182/82 |
| 5,829,549 | A * | 11/1998 | Flynn | 182/82 |
| 6,702,065 | B2 * | 3/2004 | Ehnes | 182/150 |
| 6,820,722 | B2 * | 11/2004 | Severt | 182/82 |
| 6,957,719 | B2 * | 10/2005 | Ehnes | 182/150 |
| 7,896,131 | B2 * | 3/2011 | Bronkhorst | 182/45 |
| 2001/0037914 | A1 * | 11/2001 | Preusser et al. | 182/150 |
| 2002/0084141 | A1 * | 7/2002 | Thomas | 182/82 |
| 2003/0136609 | A1 * | 7/2003 | Severt | 182/82 |
| 2008/0022628 | A1 * | 1/2008 | Bronkhorst | 52/747.1 |

* cited by examiner

*Primary Examiner* — Katherine W Mitchell
*Assistant Examiner* — Candace L Bradford
(74) *Attorney, Agent, or Firm* — Dennis L. Thomte; Thomte Patent Law Office LLC

(57) ABSTRACT

An apparatus is provided for supporting a worker on an upper chord of a roof truss. The apparatus includes a saddle member which is positioned over an installed upper chord of a roof truss and secured thereto to prevent inadvertent movement of the apparatus with respect to the upper chord upon which it is mounted. The apparatus includes a pair of hanger assemblies which are pivotally secured to the saddle member and which extend downwardly therefrom for supporting a pair of footrests thereon. In use, the worker straddles the saddle member and the chord upon which it is mounted with his/her feet resting on the footrests. The footrests may be adjusted to compensate for varying roof pitches.

11 Claims, 6 Drawing Sheets

APPARATUS FOR SUPPORTING A WORKER ON AN UPPER CHORD OF A ROOF TRUSS

BACKGROUND OF THE INVENTION

1. Field of the Invention

This invention relates to an apparatus for supporting a worker on an upper chord of a roof truss during the construction of a roof and more particularly to an adjustable apparatus for supporting a worker on an upper chord of a roof truss to compensate for different roof pitches.

2. Description of the Related Art

During the construction of a roof which is constructed of a plurality of roof trusses, a worker must attempt to support himself on a previously installed roof truss to position an adjacent roof truss and to nail the same in place at the proper spacing utilizing truss spacers or the like. Previous attempts have been made to provide a portable temporary support for workers installing roof trusses as for example, the US Publication 2008/0022628. Although the support disclosed in the published application does enable a worker to straddle the previously installed roof truss to enable an adjoining roof truss to be installed, the worker must rest his/her lower legs in the gutter or trough members which will become extremely tiring on the worker's legs and back. Another device for installing or erecting roof trusses is disclosed in U.S. Pat. No. 6,820,722 wherein a pair of supporting devices are utilized. The devices disclosed in the '722 patent do not enable the worker to straddle a roof truss and requires that the worker lean over the previously installed roof truss to reach the adjacent roof truss being installed.

From the foregoing, it can be seen that there is a definite need to provide an apparatus or device for supporting a worker on an upper chord of a roof truss which is adjustable and which is safe and convenient to use.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An apparatus is disclosed for supporting a worker on an upper chord of a roof truss. The apparatus includes an elongated, channel-shaped saddle member, having upper and lower ends, for embracing the upper chord with the saddle member including a top wall and spaced-apart side walls extending downwardly therefrom. The apparatus also includes an upper hanger assembly which is pivotally secured, about a horizontal axis to the saddle member below the upper end thereof. The apparatus also includes a lower hanger assembly having upper and lower ends with the upper end of the lower hanger assembly being pivotally secured, about a horizontal axis, to the saddle member adjacent the lower end of the saddle member. The lower ends of the upper and lower hanger assemblies are positioned below the upper chord.

A first footrest is secured to the upper and lower hanger assemblies and extends therebetween below the chord at one side thereof. A second footrest is secured to the upper and lower hanger assemblies and extends therebetween below the upper chord at the other side thereof. The first and second foot rests, by being positioned on opposite sides of the upper chord enable the worker to straddle the saddle member and the upper chord. The saddle member is selectively secured to the upper chord to prevent the movement of the saddle member with respect to the upper chord.

In the preferred embodiment, the footrests are adjustably secured to the upper hanger assembly to accommodate different roof pitches.

It is therefore a principal object of the invention to provide an improved apparatus or device for supporting a worker on an upper chord of a roof truss during the erection of a roof comprised of roof trusses.

A further object of the invention is to provide an apparatus of the type described which is adjustable to accommodate different roof pitches.

A further object of the invention is to provide an apparatus of the type described which includes means for maintaining the apparatus in position relative to the upper chord.

Yet another object of the invention is to provide an apparatus for supporting a worker on an upper chord of a roof truss wherein the worker straddles the roof truss.

Yet another object of the invention is to provide an apparatus for supporting a worker on an upper chord of a roof truss which is comfortable and safe to use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
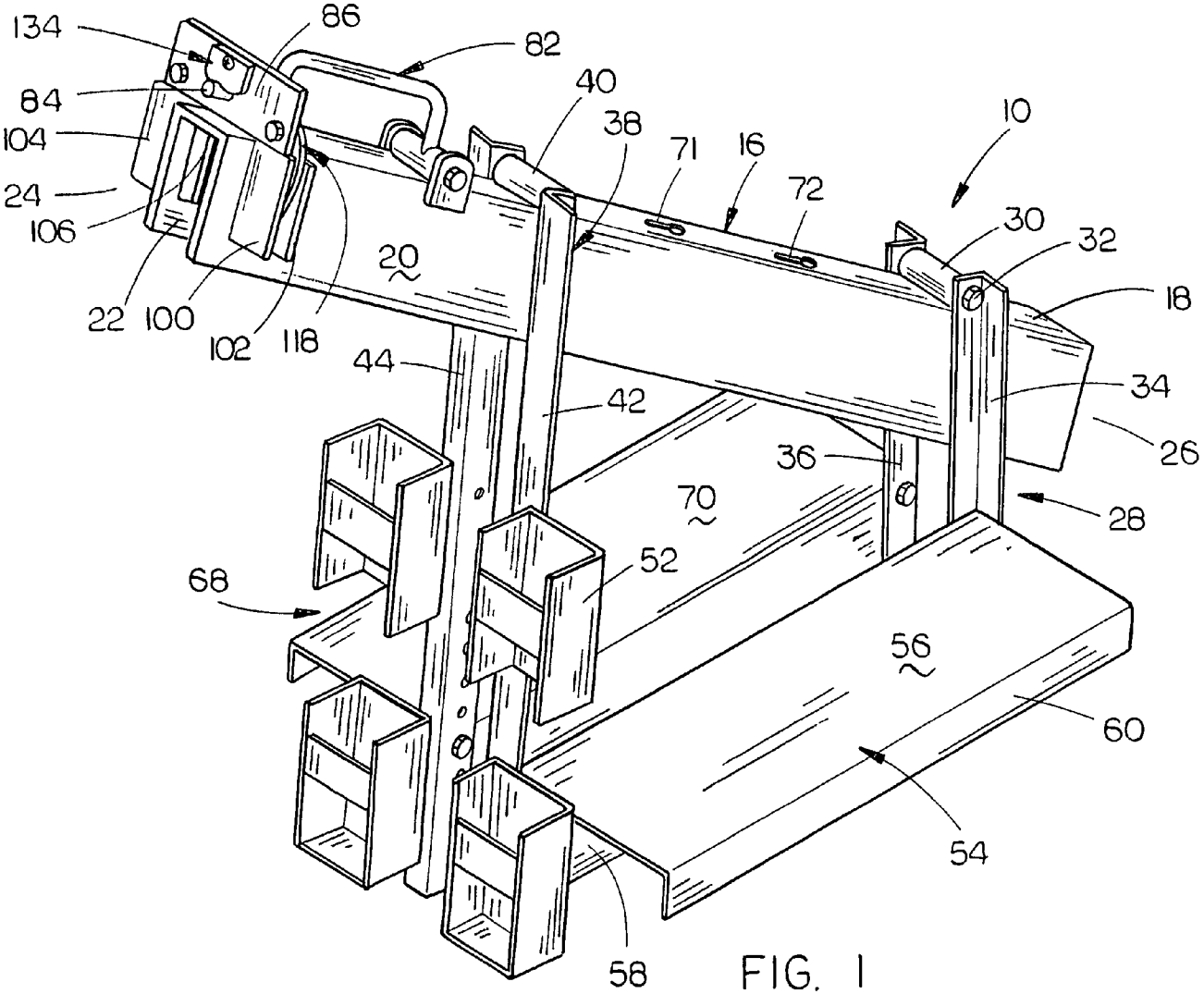
FIG. 1 is a perspective view of the worker support or worker support apparatus of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In the drawings, the numeral 10 refers to the worker support or worker support apparatus of this invention which is designed to be used with an upper chord 12 of a roof truss 14 during erection of a roof utilizing roof trusses. Support 10 includes an elongated channel-shaped saddle member 16 which is preferably comprised of a suitable metal material such as steel, or the like. Saddle member 16 includes a top wall 18 and side walls 20 and 22 extending downwardly therefrom. For purposes of description, saddle member 16 will be described as having an upper end 24 and a lower end 26.

The numeral 28 refers to a lower hanger assembly 28 which is comprised of a tube or collar 30 welded or otherwise secured to the top wall 18 of saddle member 16 adjacent the lower end thereof and which has a bolt 32 received therein. The upper ends of angular members 34 and 36 are pivotally secured to the bolt 32 at the ends of tube 30 respectively. As seen in the drawings, the lower ends of the angular members 34 and 36 are located below the upper chord 12. As also seen in the drawings, the hanger members 34 and 36 are positioned outwardly of the side walls of the saddle member 16 so as to be positioned on opposite sides of the upper chord 12.

The numeral 38 refers to an upper hanger assembly which includes a collar or tube 40 which is welded or otherwise secured to the top wall 18 of saddle member 16 at a location above the lower hanger assembly 28. The upper ends of hanger members 42 and 44 are pivotally secured to the collar 40 by means of the bolt 46 extending therethrough. The lower ends of hanger members 42 and 44 are provided with a plurality of vertically spaced openings 48 and 50 formed therein respectively to provide an adjustment for roofs of various pitches as will be described hereinafter. A plurality of cups retainers 52 or storage units are secured to the hanger members 42 and 44 to provide for the convenient storage of various tools which are employed by the worker.

The numeral 54 refers to a footrest including a top surface 56 and an inner wall 58 which extends downwardly therefrom. Preferably, the outer side of footrest 54 includes a flange or outer wall 60. One end of inner wall 58 is secured to hanger member 34 by a pair of bolts 62 and 64. The other end of inner wall 58 has a bolt 66 extending therethrough and through one of the openings 48 in hanger member 42 of upper hanger assembly 38. The bolt 66 may be placed in various of the openings 48 to accommodate for various roof pitches so that the top surface 56 of footrest 54 remains substantially horizontal regardless of the roof pitch.

A footrest 68 including an upper surface 70 is similarly secured to the hanger members 36 and 44 as was just described with respect to footrest 54. The top wall 18 of saddle member 16 is provided with a pair of spaced-apart keyhole slots 71 and 72 formed therein adapted to receive nails therein to selectively removably attach the saddle member 16 to the upper chord 12 as will be described in more detail hereinafter.

Figure 2:
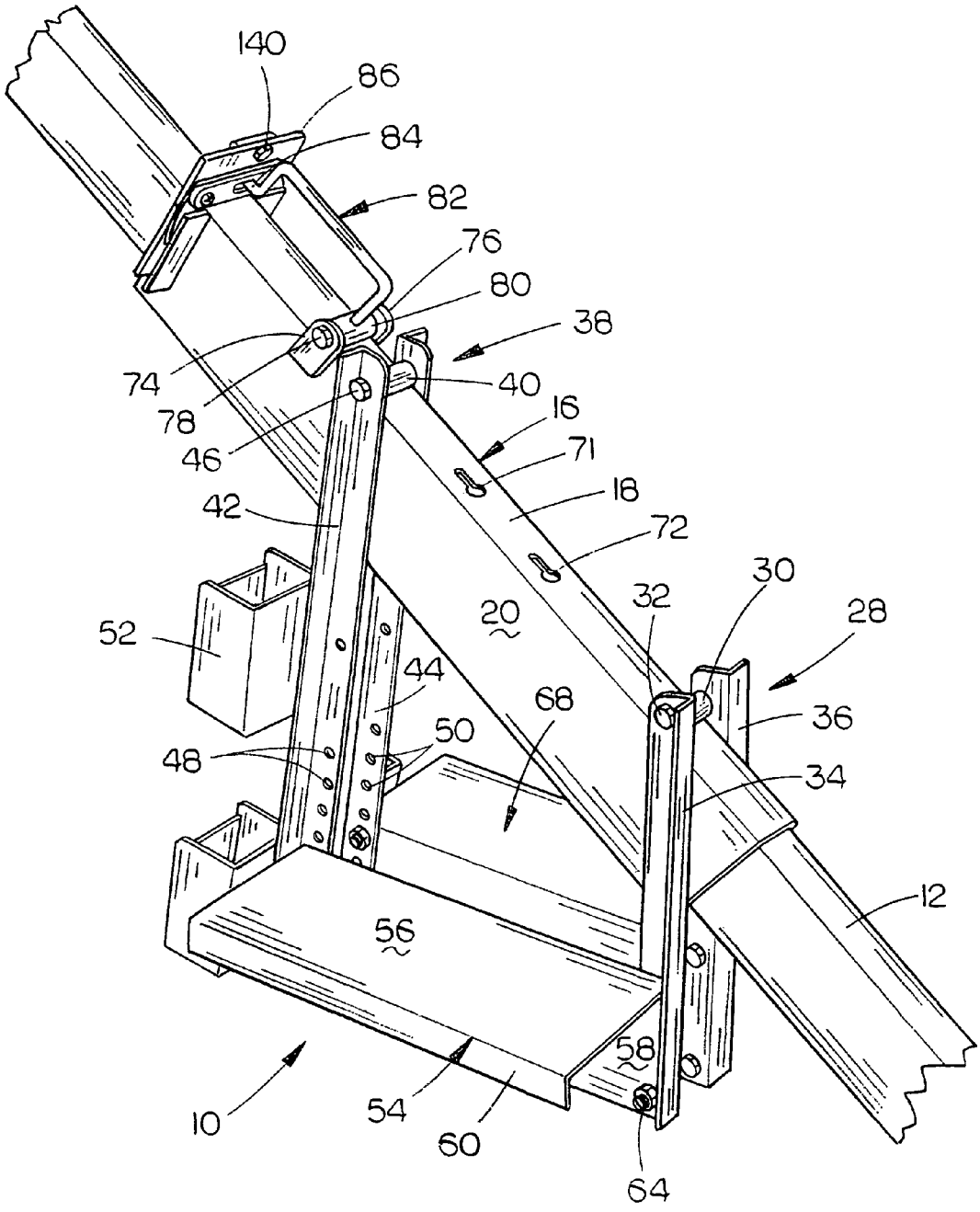
FIG. 2 is a perspective view of the worker support of FIG. 1 mounted on the upper chord of the roof truss.
Figure 3:
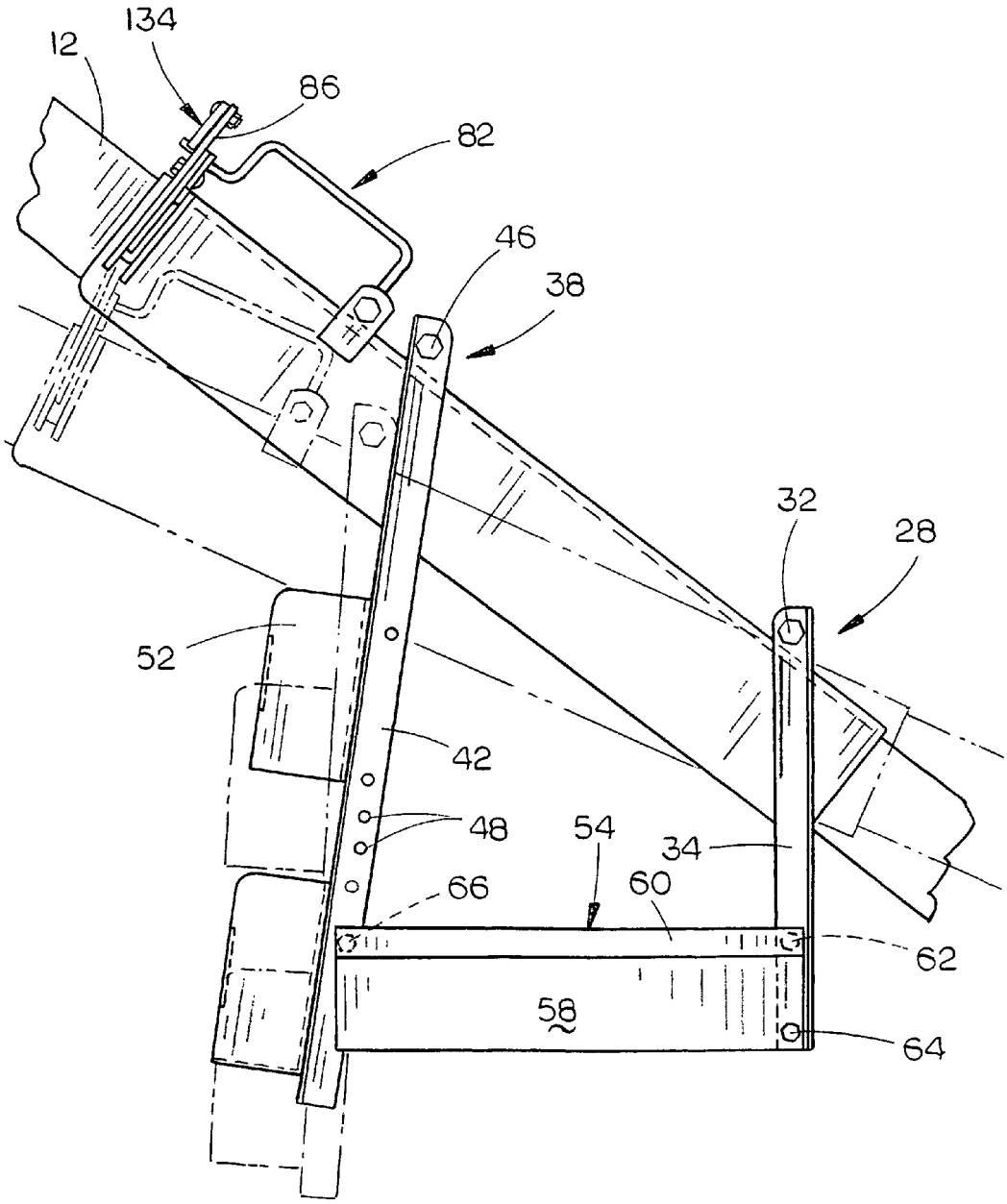
FIG. 3 is a side elevational view illustrating the adjustability of the foot rests to compensate for various pitches.

A pair of spaced-apart ears 74 and 76 are secured to sides 20 and 22 of saddle member 16 by any convenient means such as welding or the like and have a bolt 78 extending therebetween as seen in FIG. 2. Collar 80 is positioned between the ears 74 and 76 and rotatably receives a bolt 78 extending therethrough. Actuator rod or handle 82 has its lower end welded or otherwise secured to collar 80 and extends upwardly as illustrated in the drawings. The upper end of handle 82 has a forwardly extending upper end portion 84.

Figure 4:
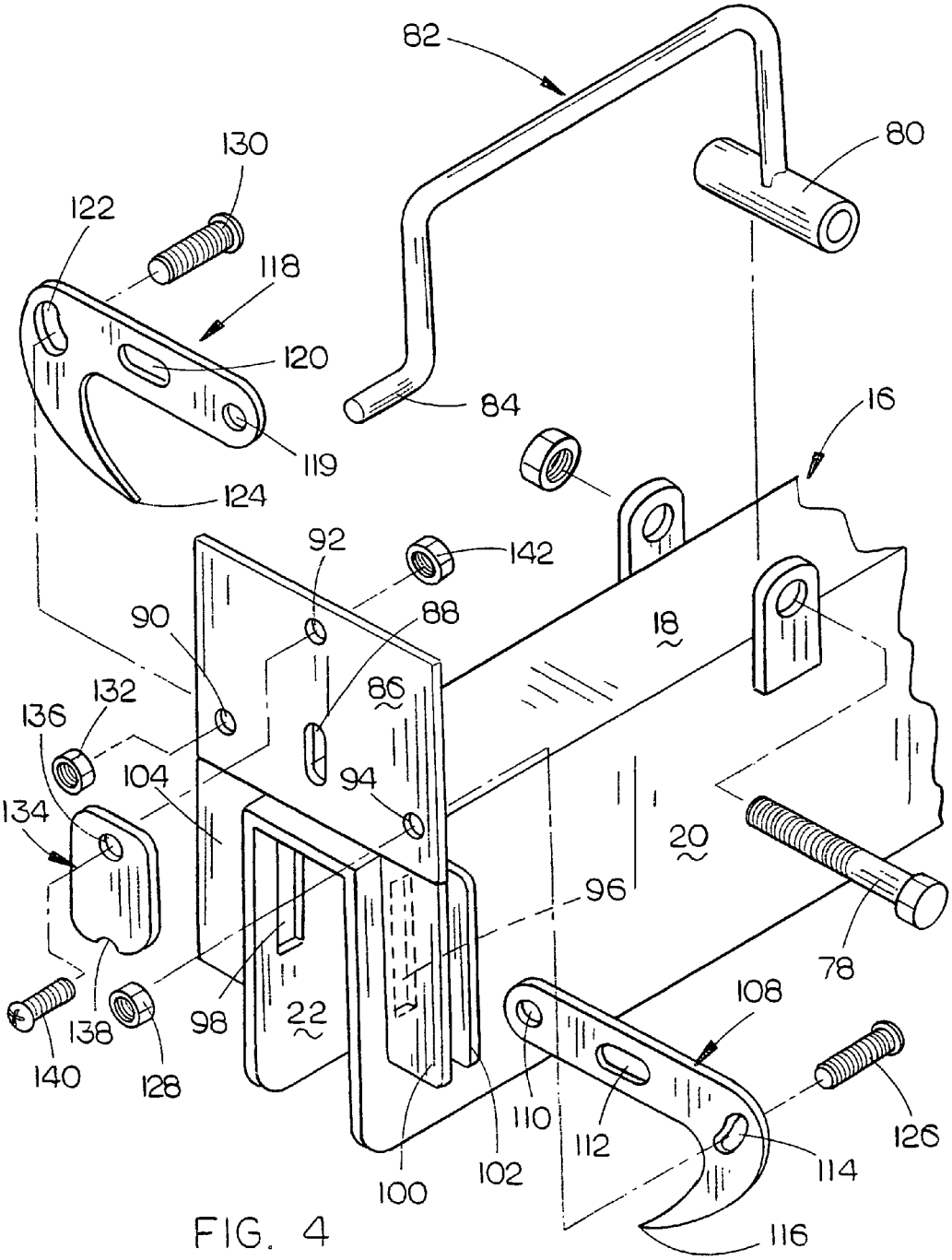
FIG. 4 is a partial exploded perspective view of means for maintaining the worker support on an upper chord of a roof truss.

Plate 86 is welded to the top wall 18 of saddle member 16 adjacent the upper end thereof and has a vertically disposed slot 88 formed therein. Plate 86 also has openings 90, 92 and 94 formed therein. As seen in FIG. 4, the sidewalls 20 and 22 of saddle member 16 have elongated slots 96 and 98 formed therein respectively. Slot 96 is positioned between laterally extending plates 100 and 102 while slot 98 is positioned between plates 104 and 106.

The numeral 108 refers to a chord gripper having an opening 110 in one lend thereof, a slot 112 formed therein the intermediate ends thereof and an arcuate slot 114. Gripper 108 also includes a tooth portion 116. The numeral 118 refers to a second chord gripper having an opening 119 at one end thereof, a slot 120 intermediate the ends thereof and an arcuate slot 122, as best seen in FIG. 4. Gripper 118 also includes a tooth portion 124.

Bolt 126 extends through arcuate slot 114 of gripper 108, through opening 119 of gripper 118 and through opening 94 in plate 86. Nut 128 secures the bolt 126 in position. Bolt 130 extends through arcuate slot 122 of gripper 118, through opening 110 in gripper 108 and through opening 90 in plate 86. Nut 132 secures 130 in place. The end portion 84 of handle 82 extends through slot 112 in gripper 108, through slot 120 in gripper 118 and through slot 88 in plate 86.

The numeral 134 refers to a locking plate having an opening 136 at its upper end and an arcuate recess portion 138 formed in its lower end. Plate 134 is positioned adjacent the upper end of plate 86 and bolt 140 extends through opening 136 in plate 134 and through opening 92 in plate 86 and which is held in place by nut 142.

Figure 6:
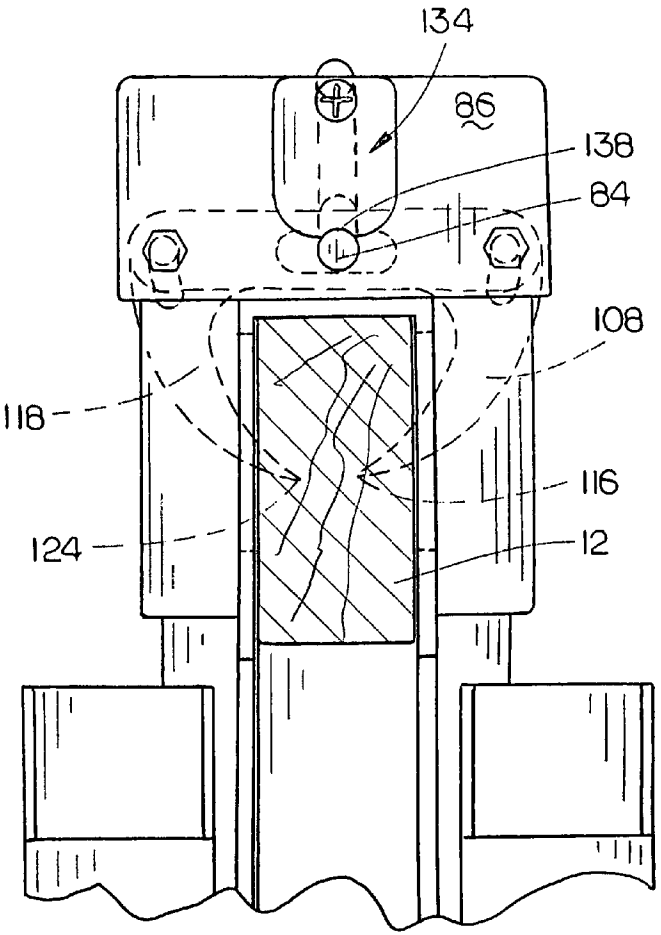
FIG. 6 is a view similar to FIG. 5 except that the chord gripping means have been forced into the upper chord of the roof truss.
Figure 5:
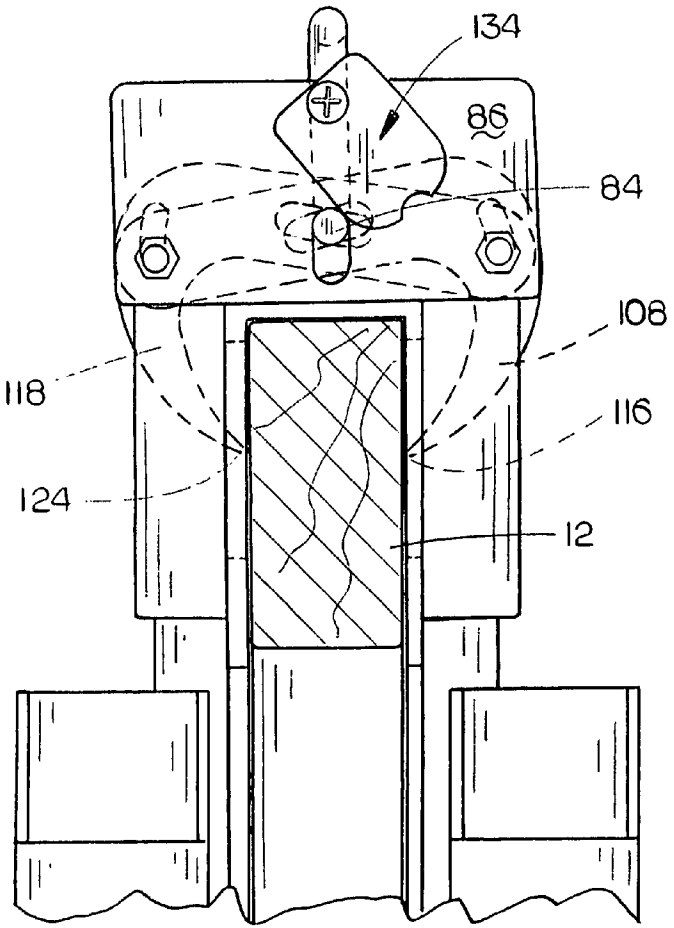
FIG. 5 is an end elevational view illustrating the chord gripping means moving into engagement with the upper chord of a roof truss.
Figure 7:
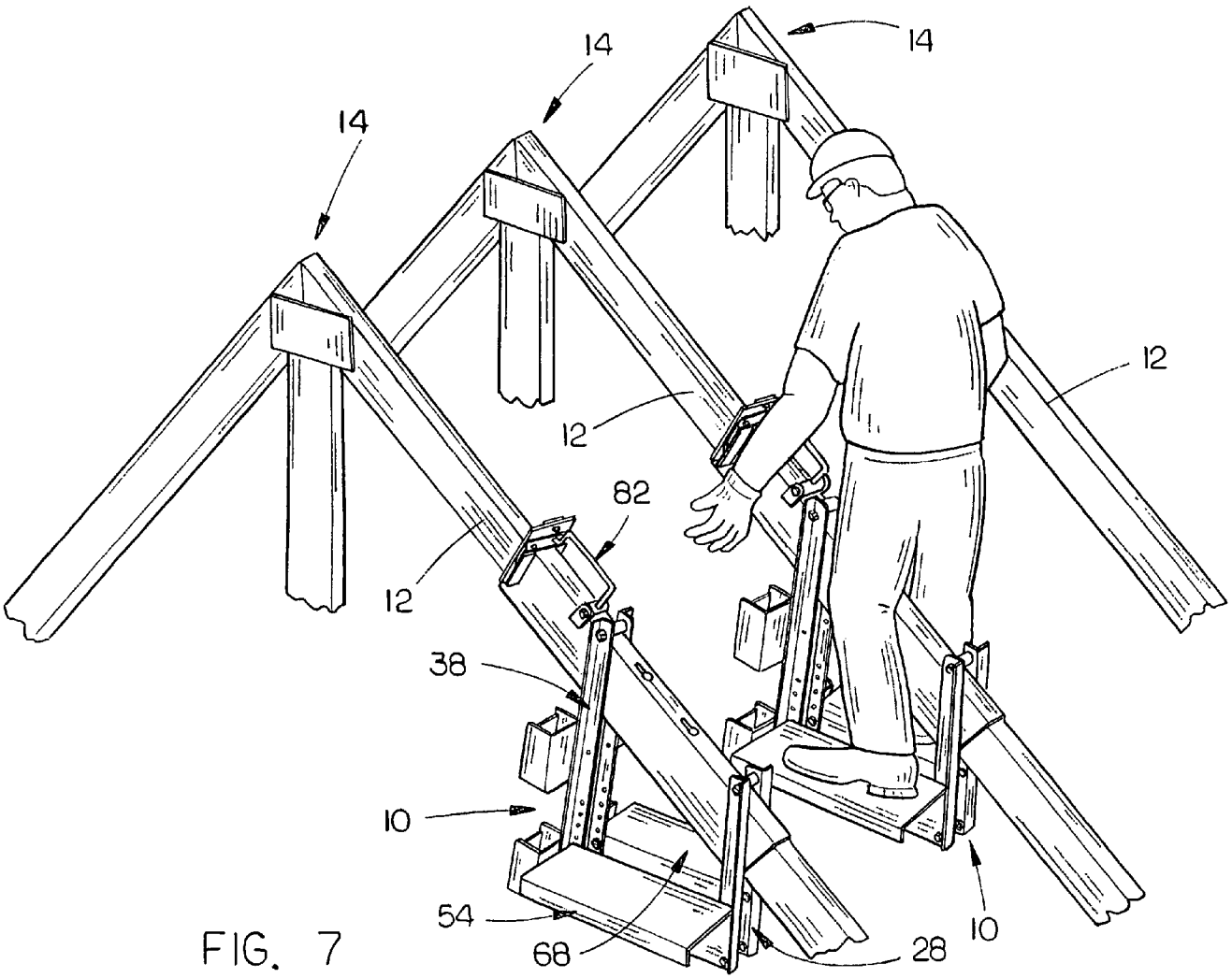
FIG. 7 illustrates the manner in which a worker uses two of the apparatuses of this invention during the erection of a roof utilizing roof trusses.

When the end portion 84 of handle 82 is in its upper position as illustrated in FIG. 5, the teeth 116 and 124 of grippers 108 and 118 are not in engagement with the upper chord 12 as will be described in more detail hereinafter. When the end portion 84 of handle 82 is in its lower position as illustrated in FIG. 6, the grippers 108 and 118 have been pivoted from the position of FIG. 5 to the position of FIG. 6 so that the teeth 116 and 124 have been driven into or forced into the upper chord 12 to securely maintain the saddle member 16 in position on the upper chord. When the plate 134 is in the locked position of FIG. 6, the recessed portion 138 thereof engages the end portion 84 of handle 82 to lock the teeth in their penetrating or piercing position of FIG. 6. When the plate 134 is in the position of FIG. 5, the handle 82 is not in its locked position.

The method of using the apparatus of this invention will now be described. Normally, the end roof truss 14 on a roof being erected will be installed in conventional fashion. After the end roof truss has been erected, the apparatus 10 will be mounted on the chord 12 of that erected roof truss. Prior to mounting the apparatus 10 on the chord 12, the locking plate 134 will be moved to its unlocked position so that the handle 82 may be moved to its uppermost position so that the hooks 116 and 124 do not protrude objectionably into the interior of the saddle member 16. The saddle member 16 is then positioned on the end of the truss so that the upper chord 12 is received within the saddle member 16. If not previously done so, a pair of nails will be driven into the upper end of the chord 12 so that the heads thereof may be received in the keyhole slots 71 and 72 with the saddle member 16 then being moved slightly downwardly so that the shanks of the nails are received within the narrow portion of the slots 71 and 72. The handle 82 will then be moved downwardly from its uppermost position to its lower locked position which causes the grippers 108 and 118 to be pivotally moved so that the teeth 116 and 124 thereof will pierce or penetrate the sides of the chord 12. The locking plate 134 is then pivotally moved to its locking position so that the recess 138 receives the end portion 84 of the handle 82 to lock the handle 82 in its lowermost position.

The worker will then straddle the saddle member 16 and place his/her feet on the footrests 54 and 68 respectively. The footrests 54 and 68 will have been previously adjusted with respect to the upper hanger assembly 38 so that the footrests will be in a generally horizontally disposed position. The next adjacent roof truss will then be moved into the roof area and the worker, while straddling the saddle member 16, will guide the roof truss into position adjacent to the roof truss which the worker is straddling. When the roof truss is in position, the worker will nail truss spacers to the previously installed truss and the truss just being installed. When the roof truss has been nailed into place, the worker will take another or a second apparatus 10 and place the same onto the most recently installed roof truss and secure it into position. The worker will then step from the apparatus 10 which he/she used to install the next truss and step onto the footrests of the second apparatus 10. The worker will then guide the next roof truss into position, while standing on the second apparatus 10 and nail that into place. When the next roof truss has been nailed into place, the worker will then remove the first apparatus 10 from its associated upper chord and place the same onto the newly installed roof truss. The first apparatus 10 is released from its associated chord 12 by pivoting the locking plate 134 out of its locking position so that the handle 82 may be raised which will cause the grippers 108 and 118 to disengage from the chord 12. The apparatus will then be moved slidably upwardly with respect to the chord 12 so that the heads of the nails in the slots 71 and 72 will register with the enlarged portions thereof so that the saddle 16 may be raised and disengaged from the chord 12. The process is repeated until all of the roof trusses are erected.

Thus it can be seen that a novel apparatus has been provided for supporting a working on an upper chord of a roof truss with the apparatus being adjusted to compensate for roof trusses of different pitches. The apparatus of this invention is convenient and safe to use primarily due to the fact that the worker is straddling the upper chord on which the apparatus 10 is mounted. Thus it can be seen that the invention accomplishes all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. An apparatus for supporting a worker on an upper chord, having first and second sides, of a roof truss, comprising:

an elongated, channel-shaped saddle member having upper and lower ends, for embracing the upper chord with the saddle member including a top wall and spaced-apart side walls extending downwardly therefrom;

an upper hanger assembly having upper and lower ends;

said upper end of said upper hanger assembly being pivotally secured, about a horizontal axis, to said saddle member below said upper end of said saddle member;

said lower end of said upper hanger assembly being positioned below the upper chord;

a lower hanger assembly having upper and lower ends;

said upper end of said lower hanger assembly being pivotally secured, about a horizontal axis, to said saddle member adjacent said lower end of said saddle member;

said lower end of said lower hanger assembly being positioned below the upper chord;

a first footrest secured to said upper and lower hanger assemblies and extending therebetween below the upper chord at the first ene side thereof;

a second footrest secured to said upper and lower hanger assemblies and extending therebetween below the upper chord at the second ether side thereof;

said first and second footrests being positioned on opposite sides of the upper chord whereby a worker may place the worker's feet thereon to straddle said saddle member and the upper chord;

said saddle member being selectively secured to the upper chord to prevent movement of said saddle member with respect to the upper chord.

2. The apparatus of claim 1 wherein said saddle member is selectively secured to the upper chord against longitudinal movement of said saddle member with respect to the upper chord and is selectively secured to the upper chord against upward movement of said saddle member with respect to the upper chord.

3. The apparatus of claim 1 wherein said footrests are adjustably vertically secured to one of said upper and lower hanger assemblies.

4. The apparatus of claim 1 wherein said footrests are adjustably vertically secured to said upper hanger assembly.

5. The apparatus of claim 1 further including storage containers which are secured to said upper hanger assembly.

6. The apparatus of claim 1 wherein said top wall of said saddle member has at least one keyhole slot formed therein whereby a nail may be extended therethrough into the upper chord.

7. The apparatus of claim 1 wherein a pair of chord gripper members are pivotally secured to said saddle member at said upper end of said saddle member for selective gripping engagement with opposite sides of the upper chord.

8. The apparatus of claim 7 wherein said chord gripper members are pivotally movable between gripping and non-gripping positions.

9. The apparatus of claim 8 wherein a pivotal rod operatively engages said chord gripper members to move said chord gripper members between their said gripping and non-gripping positions.

10. The apparatus of claim 9 further including a locking mechanism which selectively locks said pivotal rod in a position whereby said chord gripper members are locked in their said gripping positions.

11. The apparatus of claim 7 wherein each of said chord gripper members include a pointed portion which pierces into the first and second sides of the upper chord.

* * * * *